US005785765A

United States Patent [19]

Zavattoni

[11] Patent Number: 5,785,765

[45] Date of Patent: Jul. 28, 1998

[54] PICKLING OF STAINLESS STEELS WHILE CONTINUOUSLY REOXIDIZING CATALYTICALLY THE PICKLING SOLUTION

[75] Inventor: Marco Zavattoni, Castronno, Italy

[73] Assignee: Condoroil Impianti s.r.l., Casale Litta, Italy

[21] Appl. No.: 805,974

[22] Filed: Feb. 26, 1997

[30] Foreign Application Priority Data

Mar. 14, 1996 [EP] European Pat. Off. ..... 96830112

[51] Int. Cl.[6] ..... C23G 1/02

[52] U.S. Cl. ..... 134/2; 134/3; 134/10; 134/41; 423/DIG. 1

[58] Field of Search ..... 134/2, 3, 13, 10, 134/41; 423/DIG. 1, DIG. 2, 484

[56] References Cited

U.S. PATENT DOCUMENTS

| | | | |
|---|---|---|---|
| 2,155,854 | 4/1939 | Barnes et al. | 134/13 |
| 2,365,729 | 12/1944 | Schumacher et al. | 423/558 |
| 2,720,472 | 11/1955 | Miller | 134/13 |
| 3,682,592 | 8/1972 | Kovacs et al. | 423/488 |
| 3,928,529 | 12/1975 | Grulke | 423/138 |
| 4,105,469 | 8/1978 | Megy et al. | 134/41 |
| 4,166,098 | 8/1979 | Watanabe et al. | 423/139 |
| 4,248,851 | 2/1981 | Kovacs | 423/493 |
| 4,526,650 | 7/1985 | Blomquist et al. | 134/13 |
| 5,118,489 | 6/1992 | Clair et al. | 423/DIG. 1 |
| 5,154,774 | 10/1992 | Bousquet et al. | 134/3 |
| 5,354,383 | 10/1994 | Bianchi | 134/3 |

FOREIGN PATENT DOCUMENTS 1-165783 6/1989 Japan .

*Primary Examiner*—Jill Warden
*Assistant Examiner*—Saeed Chaudhry
*Attorney, Agent, or Firm*—Pollock, Vande Sande & Priddy

[57] ABSTRACT

In a pickling process for stainless steels or similar ferrous alloys, continuous reoxidation of $Fe^{2+}$ to $Fe^{3+}$ and/or NOx to nitric acid in the pickling liquor is economically performed by continuously treating a portion of the pickling liquor into a separate reactor where it is contacted with oxygen onto a catalytic bed and recycling the solution so reoxidized into the pickling bath. The need of continuously adding an oxidant in the form of hydrogen peroxide and of stabilizing compounds into the pickling bath is eliminated altogether thus achieving a dramatic reduction of the processing costs.

7 Claims, 6 Drawing Sheets

PICKLING OF STAINLESS STEELS WHILE CONTINUOUSLY REOXIDIZING CATALYTICALLY THE PICKLING SOLUTION

DESCRIPTION

Technical Field

Pickling of stainless steel (austenitic, martensitic and ferritic) and of other special alloys is usually performed with strongly acid mixtures in presence of an oxidizing agent.

The latter, besides performing a direct action in the pickling process itself, attend to the dissolution of an eventually present dechromized surface layer caused by a heat treatment, as well as to the passivation of the material, thus conferring to it stainless characteristics.

The oxidizing agent traditionally used for this type procedure is nitric acid and a typical bath utilized for the pickling of stainless steels usually employs mixtures of nitric acid and hydrofluoric acid, to which hydrochloric acid and other pickling coadjuvants such as inhibitors, wetting agents, foam promoters, and the like, may be added.

Traditionally, nitric acid has been widely used because of its low cost if compared to other more expensive oxidizing agents.

With the ever increasing environmental and safety consciousness, the use of nitric acid has recently been questioned.

The problems associated with the use of nitric acid can be summarized in three fundamental issues:

a) Water pollution

Nitrates and nitrites constitute a source of nourishment for sea weeds and therefore contribute to eutrophization phenomena.

Nitrites form nitrosamine which are in turn assimilated by fish and may constitute a cause factor in the insurgence of cancer if ingested.

At present, an economically viable technique that can be adopted by the metal industry in general to eliminate nitrites and nitrates from effluents is not at hand. This has created major difficulties in complying with effluent control normative as enacted by governments, such as in Italy. b) Air pollution The reduction reaction on nitric acid envisages the formation of nitrogen oxides represented by the general formula NOx, which are characterized by their reddish color.

These fumes, besides being toxic for may living organisms, contribute to the ill known phenomena of acid rain and as a consequence their emission in the atmosphere is regulated in almost all developed countries.

c) Toxicity for the operator

The Chemistry Encyclopaedia (UTET) reads: "Nitric acid, its fumes and other nitrogen oxides have a high level of toxicity that in serious cases may even lead to death".

Therefore, remarkable efforts have been undertaken by the industry to eliminate or reduce the problems caused by the use of this acid.

Many studies and patents have been realized in this field.

A first approach was that of eliminating the emission of nitrogen oxides in the atmosphere. Samples of these generally known proposals are:

reoxidation to nitrates in special abatement columns by the use of hydrogen peroxide or manganatelpermanganate mixtures;

reduction to nitrogen in special abatement columns by the use of urea;

catalytic combustion at high temperature;

bath reoxidation by injecting hydrogen peroxide in function of the monitored redox potential (as described in the Swedish Patent No. SE 8305648).

To the techniques developed for reducing the emissions of nitrogen oxides in the atmosphere have been added techniques for limiting the release of nitrates and nitrites in effluent liquors. Among these techniques the following have met an industrial use:

the regeneration of baths by electrodialysis, ion exchange and roasting;

the recovering of rinse water by inverse osmosis or evaporation;

reduction of nitrites via electrolysis or by the use of sulfammic acid.

However, in all the above cases, working conditions are generally improved but the problem is not completely eliminated.

On the other hand, important steps forward have been made in the last decade toward eliminating altogether the use of nitric acid.

All the techniques developed for this purpose practically make use of hydrogen peroxide as the oxidizing agent.

On a case to case basis, hydrogen peroxide acts as a direct oxidizing agent or as an oxidizer vehicle when the oxidizing action is actually carried out by trivalent iron, commonly present in the pickling solution.

Various complex reactions of oxidation take place in the pickling bath even if most frequently the predominant role is attributable to trivalent iron ($Fe^{+++}$ or $Fe^{3+}$) which exerts its oxidizing action by reducing itself to bivalent iron ($Fe^{++}$or $Fe^{2+}$) so that the function of adding hydrogen peroxide to the pickling bath would be, in this case, that of reoxidizing the bivalent iron to trivalent iron.

In reality, it is generally accepted the fact that during the pickling process both hydrogen peroxide and trivalent iron play a role.

Among any patents issued in this field, the following may be cited.

The Japanese Patent No. 243289/85 of Kobe Steel describes the use of a pickling mixture of hydrofluoric acid, hydrogen peroxide and, eventually hydrochloric acid and/or sulphuric acid.

The Patent No. DE 2,827,697 describes pickling conducted in a solution of sulphuric acid, hydrofluoric acid and ferric sulphate into which hydrogen peroxide is added to maintain the correct redox potential.

The high operation cost due to the large consumption of hydrogen peroxide in these processes has promoted the search of techniques aimed to reduce such a consumption.

A first attempt was made by the French company Ugine who, among the many patents obtained, own the European Patent No. EP 0 236 354, wherein the blowing of air through the pickling bath is disclosed as a coadjuvant of hydrogen peroxide. However, the rate of reaction of the oxygen at the typically low pH of the pickling bath is so low that it does not achieve any considerable saving, least of all an elimination of hydrogen peroxide addition.

For these reasons, special stabilizing agents have been developed and patented in order to stabilize the hydrogen peroxide even in presence of a high concentration of iron in the solution.

The Italian Patent No. 1,246,252 of the Italian company CONDOROIL CHEMICAL, discloses the use of aliphatic tertiary alcohols as specific stabilizing agents for pickling solutions of stainless steel that utilize hydrogen peroxide and sulphuric acid in total substitution of nitric acid.

However, even in this process, the consumption of hydrogen peroxide and of stabilizers implies still relatively high operation costs, especially the treating large volumes of stainless steel.

In the light of these known techniques and of their associated limitations and costs, a pickling process has now been found which is outstandingly more efficient and more economical to run if compared to the known processes.

This innovative pickling process eliminates completely any addition of hydrogen peroxide and also of the stabilizing agents that would eventually be required, achieving a surprising reduction of pickling costs while ensuring a most effective control of the emission of pollutants.

Despite of the fact that according to a particularly preferred embodiment the process of the present invention there is absence of nitric acid in the pickling solution, the invention remains effective even in presence of nitric acid in the pickling solution, which is still the case in the majority of existing plants. Indeed the process of the invention permits reoxidization of the reduction compounds of this acid, that is it is capable of reoxidizing NOx back to nitric acid.

SUMMARY OF THE INVENTION

Basically, the process of the invention consists in processing a part of the pickling solution in a reactor, separately from the pickling bath, whereby nitrogen suboxides (NOx) are reoxidized to nitric acid and/or bivalent iron to trivalent iron and in recycling the so treated solution back into the pickling bath.

The reoxidation is carried out in a reactor that essentially contains a catalytic bed by passing the pickling liquor and a gas mixture containing oxygen (or pure oxygen), in a countercurrent or in an equicurrent mode, through the catalytic bed of the reactor.

The catalytic bed may be composed of granular material and/or bodies of different shapes.

The catalytic bed may be static or fluidized. The bed may be for example fluidized by injecting from beneath, through a plurality of nozzles the pickling liquor and/or a gas mixture containing oxygen or pure oxygen, which may even be premixed together during the injection phase using special ejectors.

Alternatively, the liquor may be percolated through a fixed catalytic bed while circulating oxygen or a gas mixture containing oxygen in countercurrent to the liquor or even by premixing it with the liquor.

Basically it is important to ensure the largest number of points of contact among the catalyst, the reduced ions to be reoxidized and oxygen.

In this respect, it has now been found that the reoxidation kinetics remains high even in case the catalytic bed is completely flooded by the liquor and the gas mixture containing oxygen or the pure oxygen is bubbled through the solution that completely floods the catalytic bed.

The reactor may also contain a static bed of a noncatalytic filling material, that is to say that only a portion of a static bed may be catalytic. A noncatalytic portion of the static bed may enhance uniformity of distribution of the stream of the solution and solution of oxygen in liquid before the latter comes into contact with the catalytic bed, whether the latter is static or fluidized.

It has been found that in this way it is possible to completely eliminate the consumption of hydrogen peroxide and consequently the costs associated with this consumption as well as with that of eventual hydrogen peroxide stabilizers, as normally used for reducing the consumption of hydrogen peroxide.

Moreover, according to the method of the invention, there is no need to blow air through the pickling bath, being this a practice that aggravates the problems associated with the emission of fumes.

The most surprising aspect of the process of the invention is the amount of the reduction of the costs of the pickling processing if compared with those relative to a process without nitric acid and based on hydrogen peroxide addition for reoxidizing iron and nitrogen suboxides and on the addition of stabilizers to control the hydrogen peroxide consumption.

Based on the current market price of hydrogen peroxide and of the stabilizers most commonly used, a comparison of pickling costs with the novel process of the invention, taking into consideration the cost of compressing air or the cost of compressed oxygen, reveals a saving in favor of the process of the invention of 90% to 98% of the cost of the known processes.

Thermodynamically, oxidation of bivalent iron to trivalent iron or of NOx into nitric acid using oxygen would appear possible, nevertheless all prior attempts to use air as an oxidizing agent by bubbling it through the pickling bath have yielded scarce or null results.

According to state of the art techniques, addition of hydrogen peroxide in the pickling bath as reoxidizing agent of bivalent iron to trivalent iron, or of NOx to nitric acid is often accompanied by the blowing of air through the bath, merely as an efficient way of stirring the bath.

Indeed, the reoxidation reaction of bivalent iron to trivalent iron, or of NOx to nitric acid, although being thermodynamically favored, is kinetically impeded from progressing in acid solutions under normal temperature and pressure conditions. Attempts made with pure oxygen in place of air or by increasing the partial pressure of the oxygen and/or the temperature or by nebulizing the pickling liquor in order to improve the exchange conditions have yielded disappointingly scarce results.

By contrast, it has now been found that by contacting the pickling solution and the oxygen, either in countercurrent or in equicurrent, on a static or fluidized catalytic bed, containing a noble metal such as platinum, preferably supported onto the surface of an inert material that is not chemically attacked by the pickling solution, such as for example carbon, an extremely efficient reoxidation of bivalent iron to trivalent iron and/or of NOx to nitric acid is achieved with extremely satisfactory contact times and yields of conversion.

Noble metals like Pt, Pd, Ru, Rh, Au, and their alloys are among the catalysts that have shown to be effective in ensuring a. satisfactory kinetics of the reoxidation reaction of bivalent iron and/or of NOx contained in the solution coming from the pickling bath to trivalent iron and nitric acid, respectively. The noble metal is advantageously supported on an inert support material that is not chemically attacked by the pickling solution. Carbonaceous materials such as carbon, carbon black, barium sulphate and plastic materials such as polypropylene and ABS (acrylonitrile-butadiene-styrene copolymer) are examples of suitable supports.

The best results were obtained with platinum supported on granular coal or on a high specific surface carbon dust.

The yield in function of oxygen consumption is higher when using pure oxygen if compared to the yield obtained using air compressed at a pressure five times higher than that of pure oxygen (so as to bring the latter to a comparable partial pressure) However, this aspect does not represent a critical choice in terms of operating costs.

According to an aspect of the invention, the pickling system may comprise one or more columns or reactors of reoxidation of bivalent iron to trivalent iron and/or of NOx to nitric acid, through which a portion of the pickling solution, suitably filtered, may be passed, in cascade, before being returned to the pickling bath. The solution and the oxygen or compressed air may circulate through the catalytic bed of each reactor in a countercurrent or in equicurrent mode or even be premixed before entering the reactor.

The pickling liquor may be drawn out of the bath through the recirculation pipe that is usually present in these plants and, after filtering it, it may be injected into a first column through a plurality of nozzles that uniformly distribute the flow, for instance at the top of the column. In a top section of the column there may exist a static bed of a packing material. In this zone takes place an enrichment of the solution with oxygen aided by the large surface of liquid-gas exchange provided by this static bed of inert packing materials.

Below this first packed section there exists a catalytic bed. In the case considered of the liquor being distributed at the top of the reactor, the catalytic bed may be static. Depending on the type of embodiment the liquid may elute in countercurrent or in equicurrent mode to the gas mixture containing oxygen to the pure oxygen that may even be bubbled through a flooded catalytic bed which may be static or fluidized.

Reoxidation of bivalent iron and/or of NOx takes place primarily in the catalyzed portion of the bed.

DETAILED DESCRIPTION

Figure 1:
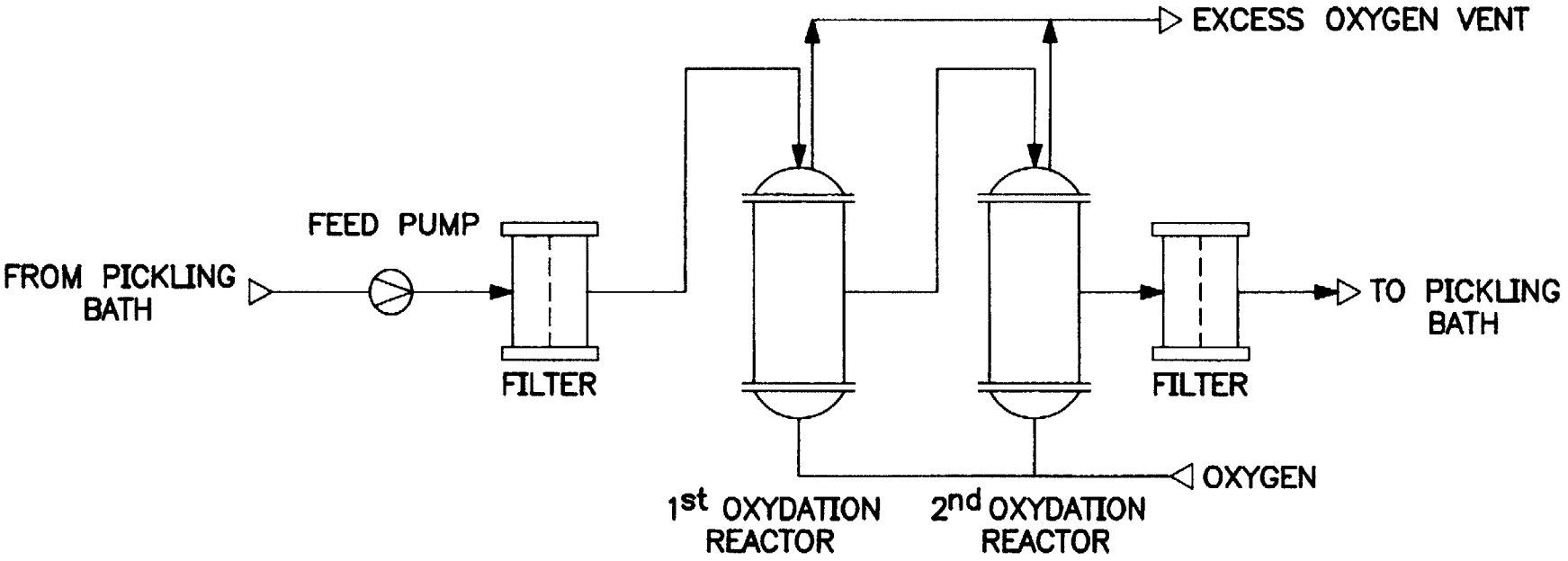
FIG. 1 shows a possible scheme of the reoxidation section of a pickling system, according to the present invention.
Figure 2:
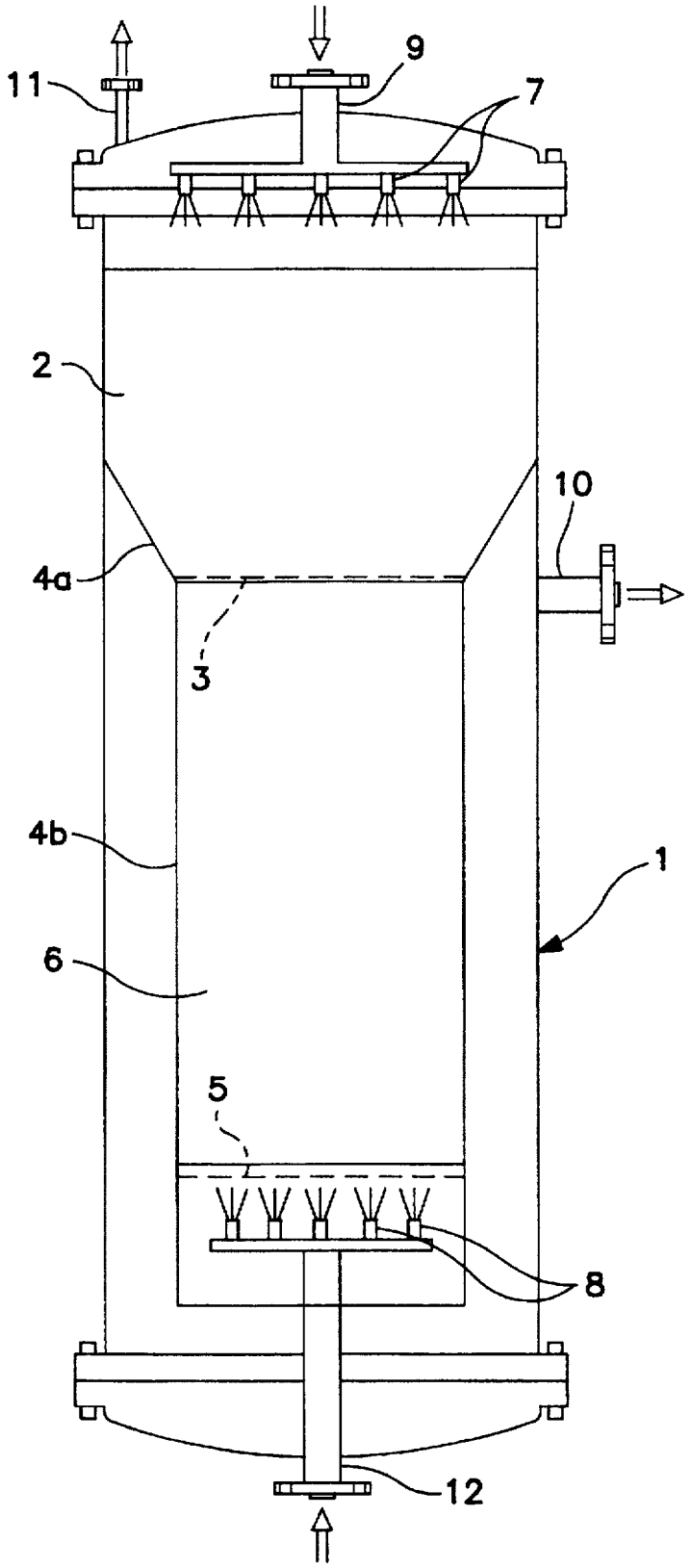
FIGS. 2 and 3 show a suitable configuration of each one of the two reoxidation columns employed in the system of FIG. 1.

In a pilot plant realized according to the scheme of FIG. 1, using two reoxidation columns in cascade having a configuration as that illustrated in FIG. 2, a number of tests were run with the purpose of demonstrating the effectiveness of the invention when applied to a commercial pickling process already operating according to the teachings contained in the Italian Patent No. 1,246,252. of CONDOROIL CHEMICAL.

By referring to FIG. 2, each reactor was constituted by a cylindrical vessel 1 closed at its two ends made of an acid resistant plastic material such as polypropylene. It could also be made of ebonized steel or of any other material chemically resistant to the pickling liquor.

According to this embodiment, the column had a first portion 2 of a static bed constituted by polypropylene saddles, resting upon a grid of polypropylene 3 that separated the upper part 4*a*, having a larger diameter, from the lower part 4*b*, having a reduced diameter, of a packaging containment pipe of polypropylene.

A second grid 5 of polypropylene defined the space occupied by a catalyzed bed 6 of platinum supported onto coal granules (catalyzer ESCAT 28D produced by the U.S. company ENGELHARD). The pickling liquor was introduced through the top nozzle 9 and distributed above the bed 2 by means of a plurality of spreader nozzles 7.

Pure oxygen was introduced through the bottom nozzle 12 and was distributed at the base of the catalyzed bed by a plurality of spreader nozzles 8.

The liquor coming from the pickling bath percolated through the bed 2 and eluted in countercurrent to the oxygen bubbled through the catalyzed bed 6 and flowed out of the reactor through the nozzle 10.

The excess (unreacted) oxygen was continuously vented through the outlet 11

The total load of catalyzer in the catalytic beds 6 of the two reactors was 80 kg, equivalent to 400 g of platinum for a purchasing cost of Lit. (Italian Lire) 17.200.000.

The commercial pickling plant at which the pilot plant was run pickles about 12 ton/hr of stainless steel using two baths, both operating with a pickling solution of hydrofluoric acid, sulphuric acid and ferric sulphate, in which, the average dosage of additives in the bath, according to the known technique, amounted to approximately 30 kg/hr of 35% by weight hydrogen peroxide and to about 7.5 kg/hr of CONDOROIL proprietary stabilizer consisting of a tertiary butyl alcohol. In practice, in the first of the two pickling baths there was a generation of about 30 kg/hr of bivalent iron, which ought to be constantly reoxidized to trivalent iron.

The dosage of hydrogen peroxide shows an efficiency or yield of about 85%–90% when comparing the actual dosage of 30 kg/hr with the stoichiometric one of 26 kg/hr.

The process implies the following costs:

| | | |
|---|---|---|
| 30 kg/hr @ 600 Lit./kg | = | 18.000 Lit./hr |
| 7,5 kg/hr @ 2650 Lit./kg | = | 20.000 Lit./hr |
| Total | = | 38.000 Lit./hr |

The cost of energy consumption for the five pumps used should be added to the above cost.

Upon installation, start-up and conduction to a steady state of operation of the pilot plant of the invention as described above and shown in the figures, consumptions of hydrogen peroxide and of the stabilizer were annulled while the consumption of air compressed at 3.5 Bar resulted of 100 $Nm^3$/hr.

This cost corresponds to that of energy consumption of a compressor of approximately 5 KW/hr capacity which, at the present rate of 150 Lit./KWh, amounts to Lit. 750 per hour.

To the running costs the cost of periodical replacement of the filters of the pickling liquor installed upstream of the two reoxidation columns should be added. This cost stabilized itself at a rate of 12 cartridges/week which, at the cost of Lit. 5.000 per cartridge, translates into an hourly cost of about Lit. 350 per hour.

The pumping cost is not taken into account in the comparison because it is substantially similar in both situations.

The theoretic consumption of air would be much lower than that of the pilot plant, namely in the vicinity of 18 $Nm^3$/hr, but despite of an evident overdimensioning of the air unsufflation, no attempt was made to reduce this rate of air injection because of the scarcely significant costs involved. Moreover, the air was supplied by a general purpose compressor whose efficiency was higher than the ordinary efficiency yield of a 5 Kw compressor.

By considering only consumptions, the comparison among operating costs, shows in the following table, shows the outstanding saving that is achieved by the process of the invention.

| Prior art process $HF/H_2SO_4/H_2O_2$/Stabilizer | Consumption and costs | | Process of the invention | Consumption and costs | |
|---|---|---|---|---|---|
| | Theo-retical | Real | | Theo-retical | Real |
| Consumption of $H_2O_2$ (Kg/h) | 26 | 30 | Consumption of compressed air ($Nm^3$/h) | 18 | 100 |
| Consumption of Stabilizer (Kg/h) | / | 7.5 | Consumption of electricity for requirement pumpings (KWh) | <5 | 5 |
| Cost of $H_2O_2$ (Lit./h) | 15.600 | 18.000 | Cost of electricity for requirement pumpings (Lit./h) | <750 | 750 |
| Stabilizer cost (Lit./h) | / | 20.000 | Cost of replacements of filters (Lit./h) | 350 | 350 |
| Cost of prior art process (Lit./h) | 15.600 | 38.000 | Cost of catalytic process (Lit./h) | <1.100 | 1.100 |

After an uninterrupted six month run, no decrease of the initial yield was noticed which indicates that there was no appreciable loss of activity of the catalyst.

To the hourly cost of oxygen consumption should be added the amortization costs of the plant although these cost are in practice not much dissimilar from the costs for realizing appropriate storage and dosing systems for hydrogen peroxide and for the stabilizer. Therefore, being these investments comparable, the outcome is an approximately net saving that corresponds to the costs of hydrogen peroxide and stabilizer addition to the bath.

After a six month run in a steady mode of the pilot plant it has not yet been possible to quantify the amortization cost of the catalyst load in function of its operative life. However, the purchasing cost was practically "paid back" after just one month of operation of the pilot plant.

The process of the invention has been tested also in laboratory scale for different pickling bath conditions and all the results confirm its exceptional effectiveness in the tested cases of baths containing:

from 1 to 80 g/lt. of hydrofluoric acid and/or of salts thereof;

from 0 to 200 g/lt. of nitric acid and/or of salts thereof;

from 0 to 200 g/lt. of sulphuric acid and/or of salts thereof;

from 0 to 150 g/lt. of other inorganic acids belonging to the group composed of fluoroboric acid, phosphoric acid and of organic acids such as citric acid and/or salts thereof;

from 0 to 50 g/lt. of $Fe^{2+}$;

from 0 to 150 g/lt. of $Fe^{3+}$.

The effectiveness of the invention has been tested also in the case of a most traditional pickling process employing a mixture of nitric acid and hydrofluoric acid with and without addition of sulphuric acid.

Also these tests were carried out in laboratory and have not yet repeated in a pilot plant.

The parameter that was observed was the concentration of nitrogen oxides (NOx) in the fumes released by the pickling solution when the liquor was and was not circulated through a reoxidation reactor fed with oxygen and equipped with the same catalyzer used in the pilot plant.

These tests demonstrated a marked reduction of the concentration of nitrogen oxides (NOx) in the fumes when the solution was continuously reoxidized and recycled to the pickling bath.

Figure 3:
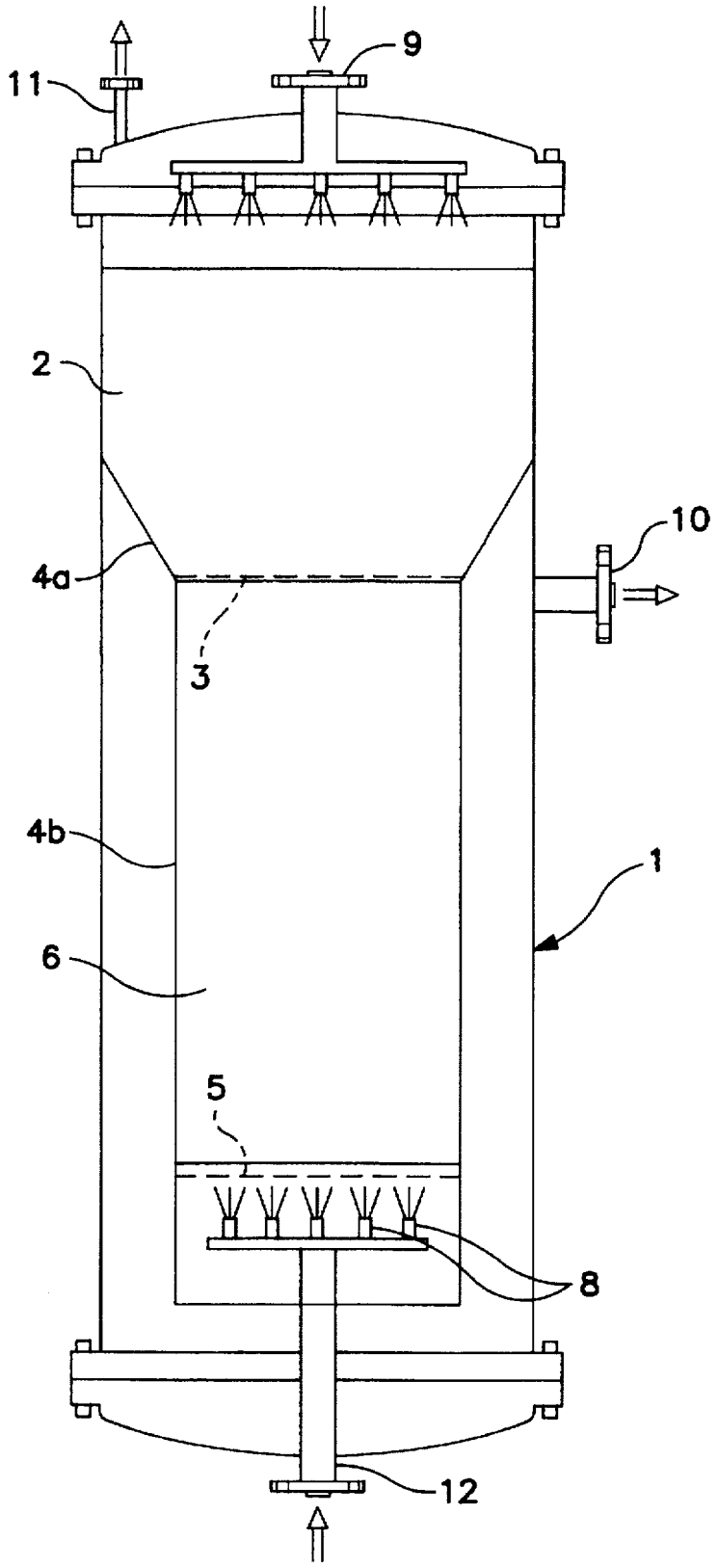

FIG. 3 shows an alternative embodiment in which the catalytic bed 6 of platinum supported on coal granules is fluidized by injecting compressed air through a plurality of nozzles 8.

Figure 4:
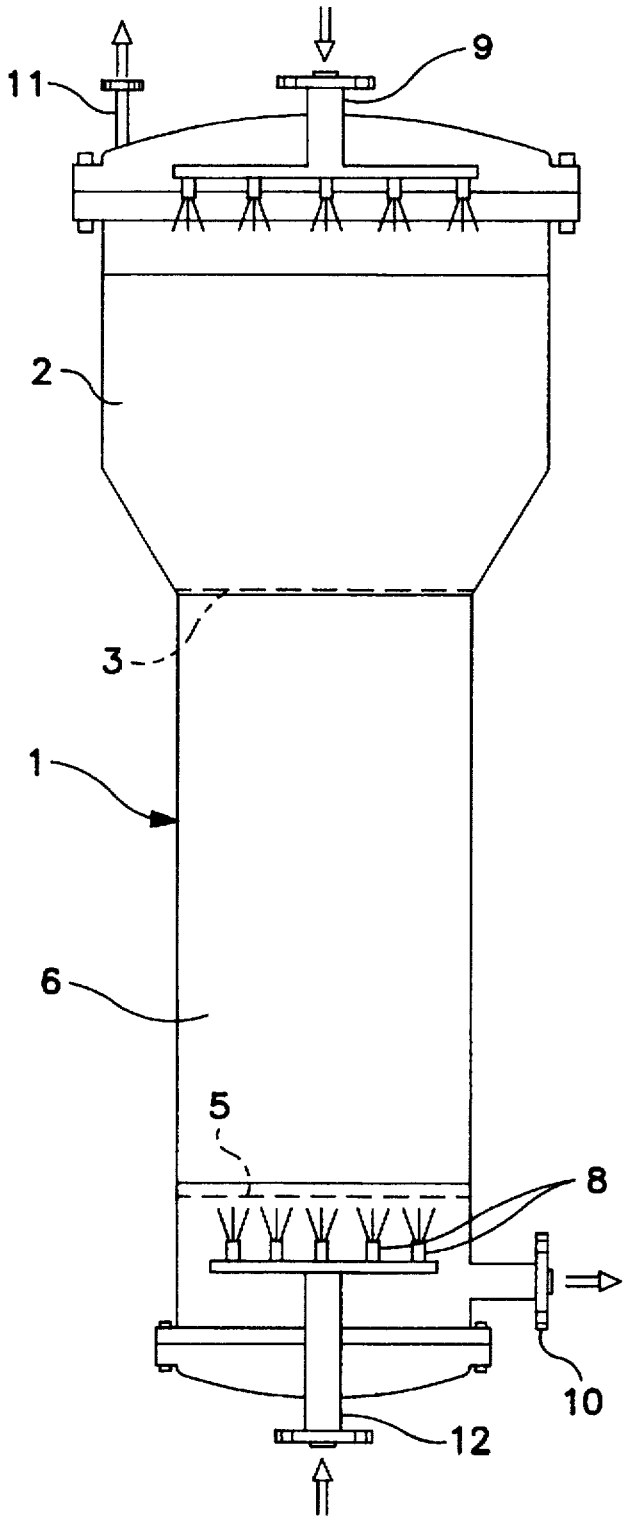
FIGS. 4, 5 and 6 show as many alternative configurations of the reoxidation column of the pickling system of the invention.

FIG. 4 shows another alternative embodiment, wherein both static beds 2 and 6 are traversed in succession by the pickling solution percolating through the bed 2 and the catalyzed granules of the catalytic bed 6 and in countercurrent to the flow of oxygen. Differently from the example of FIG. 2, the catalytic bed 6 is not floaded by the liquid which is continuously discharged through the outlet 10 which, in this case, is located at the bottom of the reactor 1.

Figure 5:
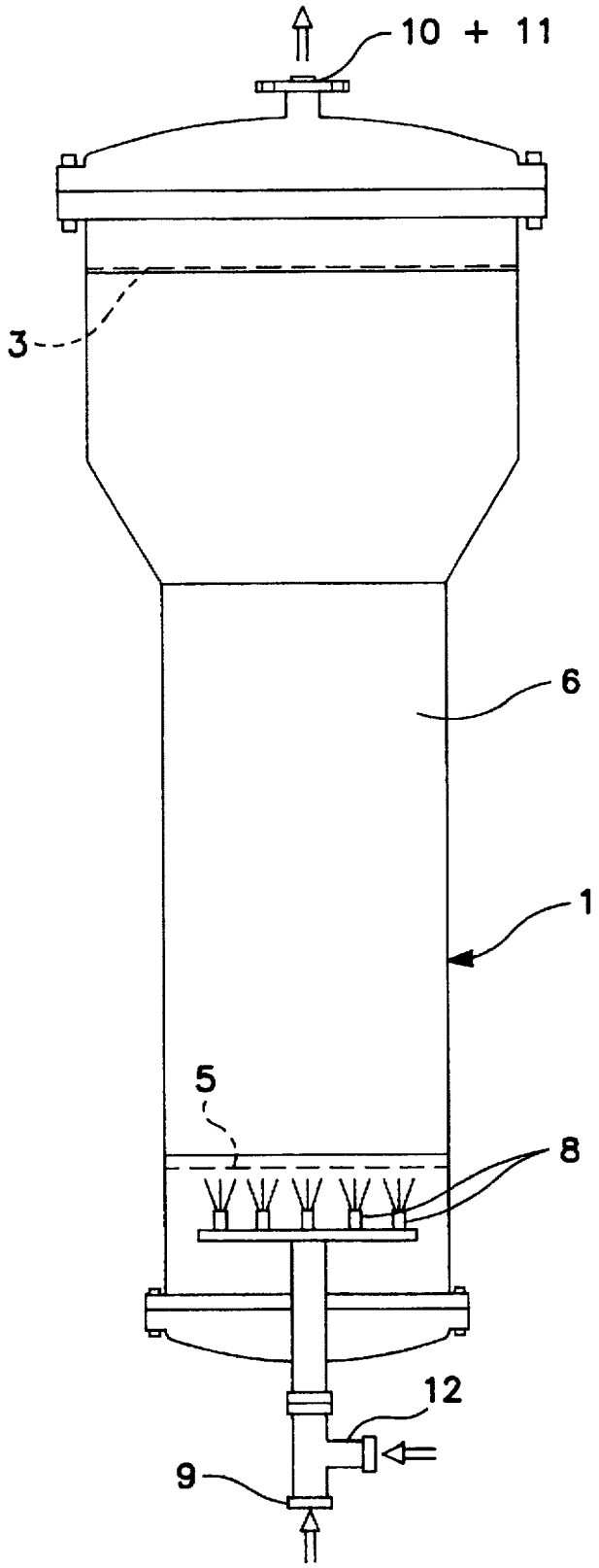

FIG. 5 shows another embodiment of a reoxidation reactor for the pickling solution.

According to this embodiment, the reoxidation column contains a fluidized catalytic bed 6 that is maintained in a fluidized state by the solution premixed with oxygen which is injected through a plurality of nozzles 8. In this case through the outlet 10+11 placed at the top of the column both the reoxidized solution and the excess gas and/or oxygen are released.

Figure 6:
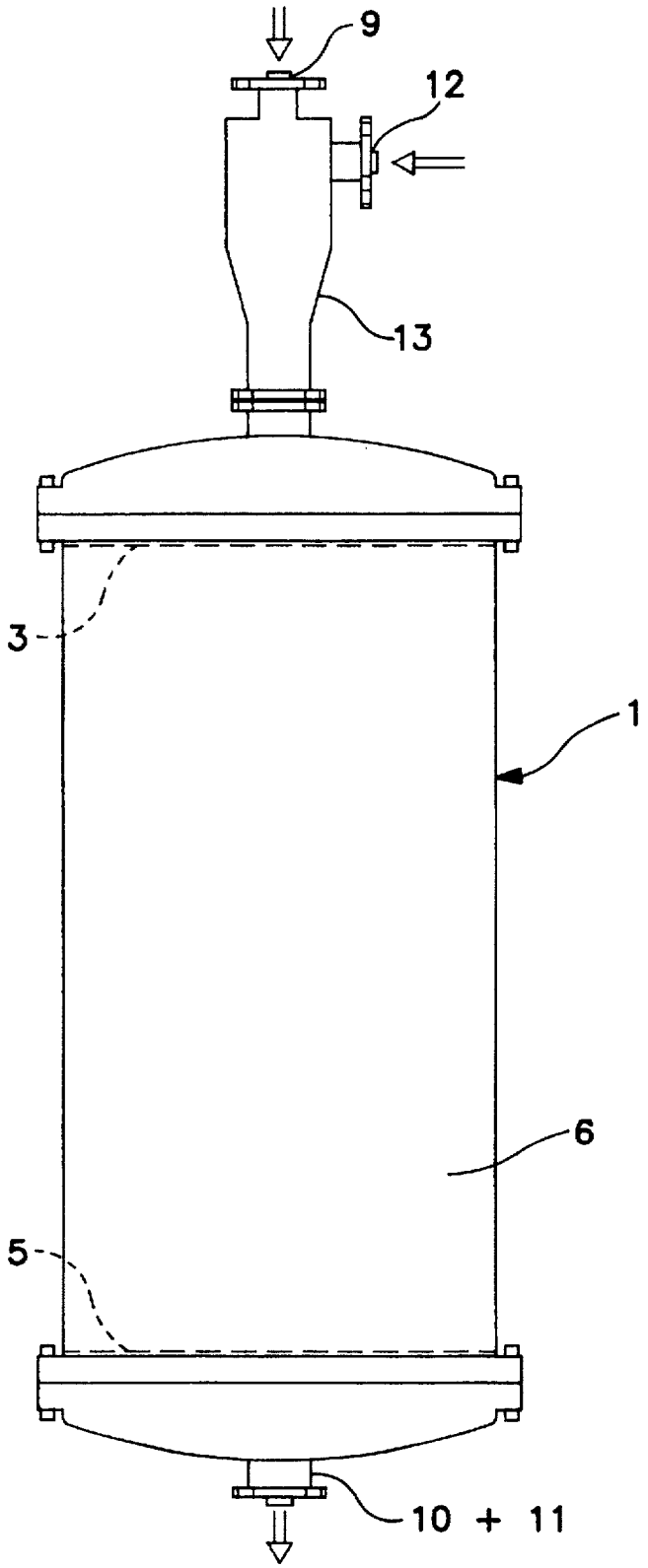

Yet another satisfactory configuration of the reoxidation reactor may be as illustrated in FIG. 6. According to this embodiment, the reactor contains internally a static or fixed catalytic bed which is crossed in an equicurrent mode by a premixed stream of pickling solution and oxygen. The reactor may be disposed vertically, horizontally or even upside-down. In one case the catalytic bed my be kept drained so to permit percolation of the liquor through the bed 6 in presence of gas. In the other case, the bed 6 may be maintained flooded by the liquor through which the gas bubbles. Dispersion of the gas in minicule bubbles in the liquor may be assumed by the use of special ejectors 13.

Of course, other suitable configurations of the reactor or reactors may be satisfactorily used, likewise mechanical stirrers may also be employed for fluidizing the catalytic bed or to promote contact among the reacting phases.

I claim:

1. A process of pickling stainless steel or ferrous alloys which comprises contacting the steel or ferrous alloy to be pickled with an aqueous acid solution containing at least a reducible oxidizing agent and treating a portion of the pickling solution in a separate reactor, reoxidizing said, reduced agent by catalytic reoxidation and recycling the solution treated into the pickling bath;

wherein said treating includes contacting said pickling solution with a noble metal catalyst supported on a material inert to the pickling solution, in the presence of oxygen.

2. The process according to claim 1, characterized in that said aqueous acid solution containing an oxidizing agent reducible during the pickling and that is reoxidized comprises:

from 1 to 80 g/lt. of hydrofluoric acid and/or of salts thereof;

from 0 to 200 g/lt. of sulphuric acid and/or of salts thereof;

from 0 to 200 g/lt. of nitric acid and/or of salts thereof;

from 0 to 150 g/lt. of other inorganic acids belonging to the group composed of fluoroboric acid and phosphoric acid and organic acids and/or of salts thereof;

from 0 to 50 g/lt. of $Fe^{2+}$; and from 0 to 150 g/lt. of $Fe^{3+}$.

3. The process according to claim 2, characterized in that said noble metal is selected from the group composed of palladium, platinum, gold and alloys thereof, and said inert material is selected from the group composed of carbon, barium sulphate, polypropylene and acrylonitrile-butadiene-styrene copolymer.

4. The process according to claim 1 characterized in that said oxidizing agent is a soluble ferric compound, the trivalent ion iron in the solution constituting an oxidizing agent and being reducible to bivalent ions of iron that are reoxidized to trivalent ions of iron.

5. The process according to claim 1, characterized in that said oxidizing agent is nitric acid the pentavalent ions of pentavalent nitrogen constituting an oxidizing agent and being reducible to subvalent nitrogen ions (NOx) that are reoxidized to hexavalent nitrogen ions.

6. The process according to claim 1, characterized in that said reoxidation treatment is performed on a static or fluidized bed containing at least partially particles of inert material supporting a noble metal catalyst.

7. The process according to claim 1, characterized in that said noble metal is selected from the group composed of palladium, platinum, gold and alloys thereof, and said inert material is selected from the group composed of carbon, barium sulphate, polypropylene and acrylonitrile-butadiene-styrene copolymer.

* * * * *